US007430391B2

(12) United States Patent
Hanashi

(10) Patent No.: US 7,430,391 B2
(45) Date of Patent: Sep. 30, 2008

(54) IMAGE FORMING APPARATUS FEATURING A CLEANING DEVICE INCLUDING A CONDUCTIVE SUPPORT MEMBER PROVIDED BETWEEN A DEVELOPING MEMBER AND A CHARGING MEMBER

(75) Inventor: Ryo Hanashi, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 262 days.

(21) Appl. No.: 11/259,247

(22) Filed: Oct. 27, 2005

(65) Prior Publication Data

US 2006/0104681 A1 May 18, 2006

(30) Foreign Application Priority Data

Nov. 12, 2004 (JP) ..... 2004-329876

(51) Int. Cl.
*G03G 15/01* (2006.01)
*G03G 21/00* (2006.01)

(52) U.S. Cl. ..... 399/299; 399/302; 399/351

(58) Field of Classification Search ..... 399/298, 399/299, 302, 303, 350, 351
See application file for complete search history.

(56) References Cited

U.S. PATENT DOCUMENTS 4,496,644 A 1/1985 Ateya et al. ..... 430/122

FOREIGN PATENT DOCUMENTS

JP 55-32060 3/1980
JP 59-165082 9/1984

*Primary Examiner*—William J Royer
(74) *Attorney, Agent, or Firm*—Fitzpatrick, Cella, Harper & Scinto

(57) ABSTRACT

A support member for supporting a cleaning blade on an upstream side is arranged between a charging roller on an image forming unit of the upstream side and a developing sleeve of an image forming unit on a downstream side. The support member is formed using a conductive member (metallic plate), is arranged to completely go across a tangent between the charging roller and the developing sleeve, and is grounded. Even when a developing bias is applied to the developing sleeve during application of a charging bias to the charging roller, the support member can function as a shielding member to prevent noise in the charging bias, which makes it possible to reduce a distance between the image forming units.

7 Claims, 4 Drawing Sheets

IMAGE FORMING APPARATUS FEATURING A CLEANING DEVICE INCLUDING A CONDUCTIVE SUPPORT MEMBER PROVIDED BETWEEN A DEVELOPING MEMBER AND A CHARGING MEMBER

BACKGROUND OF THE INVENTION

1. Field of the Invention

The present invention relates to an image forming apparatus such as a full-color printer, which adopts an electrophotographic system. In particular, the present invention relates to an arrangement of a conductive support member provided to support a cleaning member.

2. Related Background Art

FIG. 6 shows a four-color full-color image forming apparatus adopting a tandem system. In the image forming apparatus, four image forming units (image forming portions) are arranged in order from upstream to downstream along a rotation direction of a recording material bearing belt (recording material bearing member) 107 (direction of an arrow R7). That is, a first (yellow) image forming unit Pa, a second (magenta) image forming unit Pb, a third (cyan) image forming unit Pc, and a fourth (black) image forming unit Pd are arranged in the stated order. The first, second, third, and fourth image forming units Pa, Pb, Pc, and Pd are respectively provided with photosensitive drums 101*a*, 101*b*, 101*c*, and 101*d* that are each rotatable in the arrow direction (clockwise direction in FIG. 6). The photosensitive drums 101*a*, 101*b*, 101*c*, and 101*d* are respectively charged by charging rollers (chargers) 102*a*, 102*b*, 102*c*, and 102*d*. Next, exposure by exposing devices 103*a*, 103*b*, 103*c*, and 103*d* is performed. Then, through development by developing devices 104*a*, 104*b*, 104*c*, and 104*d*, toner images of yellow, magenta, cyan, and black are formed on respective surfaces of the photosensitive drums 101*a*, 101*b*, 101*c*, and 101*d*. The toner images of the respective colors are superimposingly transferred to a recording material P conveyed from a sheet feeding cassette 108 and borne on a surface of the recording material bearing belt 107 in succession by transferring chargers 105*a*, 105*b*, 105*c*, and 105*d*. Toner (transfer residual toner) that remains on the surfaces of the photosensitive drums 101*a*, 101*b*, 101*c*, and 101*d* after the toner image transfer, is removed by cleaning devices 106*a*, 106*b*, 106*c*, and 106*d*. On the other hand, the recording material P after the toner image transfer is separated from the recording material bearing belt 107 and is conveyed to a fixing device 109 at which the toner images are fixed onto the surface of the recording material P through heating and pressurizing.

In the image forming apparatus described above, the charging rollers 102*a*, 102*b*, 102*c*, and 102*d*, which are advantageous in terms of stability of charging, downsizing and simplification of the apparatus, and the like, are suitably used as chargers. As charging biases applied to the charging rollers 102*a*, 102*b*, 102*c*, and 102*d*, only direct current components are used in some cases and components including direct current components and alternating current components superimposed on each other are used in other cases. In addition, as to the developing devices 104*a*, 104*b*, 104*c*, and 104*d*, a developing device using a two-component developing method is described in Japanese Patent Application Laid-open No. 55-32060 A and Japanese Patent Application Laid-open No. 59-165082 A. With the two-component developing method, non-magnetic toner and magnetic carrier are borne on surfaces of developing sleeves. Then, through application of alternating electric fields to the developing sleeves as developing biases, electrostatic latent images on the photosensitive drums are developed with the toner.

In the image forming apparatus adopting the tandem system described above, the four image forming units Pa, Pb, Pc, and Pd are arranged along the rotation direction of the recording material bearing belt 107. So, there is a tendency in that the overall size of the apparatus increases. To downsize the apparatus, it is effective to arrange the respective image forming units Pa, Pb, Pc, and Pd in proximity to one another.

In this case, however, the charging roller of the image forming unit of the upstream side and the developing sleeve on the image forming unit on the downstream side are arranged in proximity to each other, which causes the following problem.

In the image forming apparatus described above, at the time of image formation, during charging of the photosensitive drum on the upstream side through application of a high-voltage charging bias to the charging roller on the upstream side, a high-voltage developing bias is applied to the developing sleeve of the developing device on the downstream side. Therefore, due to changing of a high voltage induced in the developing sleeve, noise occurs in the charging bias applied to the charging roller and unevenness of surface potentials of the photosensitive drum occurs, which leads to a problem in that density unevenness occurs in a final toner image. Note that such a problem occurs also in the case of an image forming apparatus that uses an intermediate transferring belt (intermediate transferring member).

It should be noted here that a counter measure is conceivable with which the charging unevenness is prevented by newly providing a shield between the charging roller on the upstream side and the developing sleeve on the downstream side, although in this case, the number of components increases and also downsizing is hindered.

It is therefore, an object of the present invention to provide an image forming apparatus including multiple image forming units, with which charging unevenness ascribable to disposal of upstream-side charging means and downstream-side developing means in proximity to each other is suppressed without adding any new components and downsizing is possible.

SUMMARY OF THE INVENTION

An object of the present invention is to provide an image forming apparatus with which charging unevenness ascribable to disposal of upstream-side charging means and downstream-side developing means in proximity to each other is suppressed.

Another object of the present invention is to provide an image forming apparatus including: at least two image forming means that each include: an image bearing member; a charging member that charges a surface of the image bearing member; developing means including a developing member that develops an electrostatic latent image formed through exposure; and cleaning means including a cleaning member and a conductive support member that supports the cleaning member and is grounded, for cleaning the surface of the image bearing member after developer image transfer, the at least two image forming means being disposed in proximity to each other, in which the support member is provided between the developing member and the charging member, for charging the image bearing member adjacent to the developing member, and is arranged to shield an estimated angle of the developing member with respect to the charging member.

Other objects of the present invention will become apparent from the following description.

DESCRIPTION OF THE PREFERRED EMBODIMENTS

Figure 1:
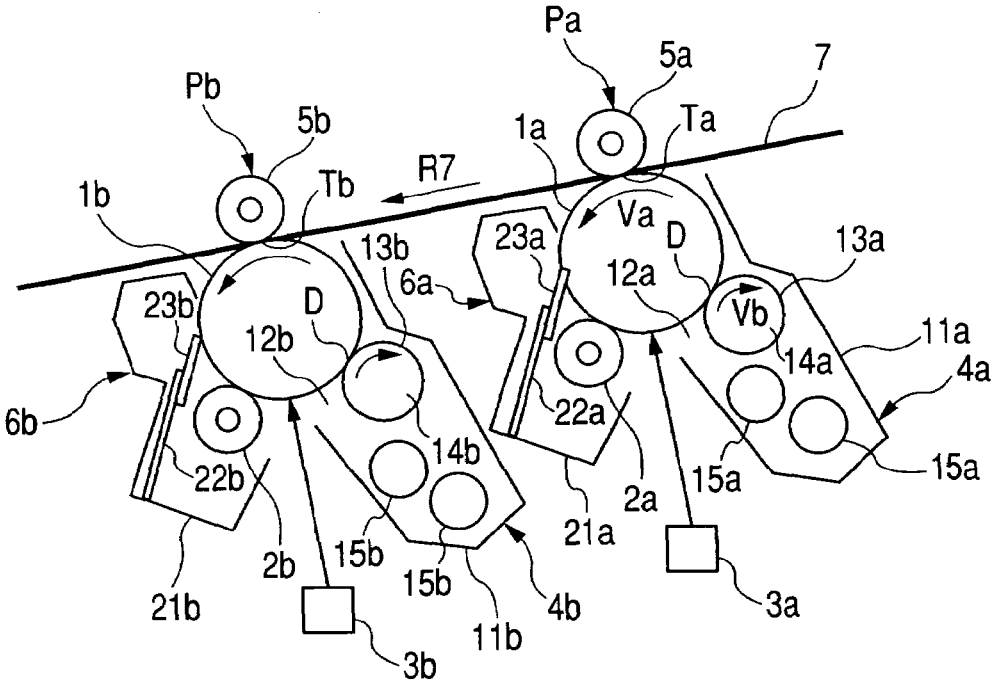
FIG. 1 is a vertical cross-sectional view schematically showing constructions of an image forming unit of an upstream side and an image forming unit of a downstream side according to a first embodiment of the present invention.

Hereinafter, embodiments of the present invention will be described with reference to the accompanying drawings. Note that each construction element given the same reference symbol in the drawings has the same construction or the same action and repetitive description thereof will be omitted as appropriate.

First Embodiment

FIG. 1 shows a part of an image forming apparatus to which it is possible to apply the present invention. The image forming apparatus in the figure is an image forming apparatus adopting an electrophotographic system, a tandem system, and an intermediate transferring member system and a part of a general construction of the image forming apparatus is schematically shown in the figure.

The image forming apparatus includes an intermediate transferring belt 7 that is an intermediate transferring member and a first image forming unit (image forming means) Pa is arranged on an upstream side along a rotational direction of the intermediate transferring belt 7 (direction of an arrow R7). Also, a second image forming unit (image forming means) Pb is arranged on a downstream side.

In the image forming units Pa and Pb, photosensitive drums 1*a* and 1*b* that are image bearing members are respectively arranged. Around the photosensitive drums 1*a* and 1*b*, charging rollers 2*a* and 2*b* that are charging members, exposing devices 3*a* and 3*b* that are latent image forming means, developing devices (developing means) 4*a* and 4*b* that are developing members and respectively include developing sleeves (developing rollers) 13*a* and 13*b*, transferring rollers (transferring chargers) 5*a* and 5*b* that are transferring means, and cleaning devices 6*a* and 6*b* that are cleaning means are arranged in this order along the rotational direction of the photosensitive drums 1*a* and 1*b* (arrow directions in the figure). Also, the intermediate transferring belt 7 is moved (rotated) in the direction of the arrow R7 between the photosensitive drums 1*a* and 1*b* and the transferring rollers 5*a* and 5*b* in the respective image forming units Pa and Pb. Further, on an upstream side of the intermediate transferring belt 7 along the rotational direction of the intermediate transferring belt 7, a sheet feeding and conveying device (not shown) that is sheet feeding and conveying means for supplying a recording material P to the intermediate transferring belt 7 is arranged. Still further, on a downstream side of the intermediate transferring belt 7, a fixing device (not shown) that is fixing means is disposed.

Hereinafter, as below, in detail, the embodiment will be explained from the photosensitive drums 1*a* and 1*b*.

The photosensitive drums 1*a* and 1*b* that are image bearing members each include a conductive cylindrical base member made of aluminum or the like and a photosensitive layer (organic photo-semiconductor, for instance) provided for the outer peripheral surface of the base member. The photosensitive drums 1*a* and 1*b* are each rotationally driven by drive means (not shown) in the arrow direction at a predetermined process speed Va (peripheral velocity).

The charging rollers 2*a* and 2*b* are each obtained by coating the outer peripheral surface of a metal core having a diameter of 8 mm with a cylindrical elastic member, providing a resistance adjusting layer for the outer peripheral surface of the elastic member, and further providing a protective layer for a surface of the resistance adjusting layer. The resistance values of the charging rollers 2*a* and 2*b* are set at $10^4$ to $10^8$ Ω·cm. The charging rollers 2*a* and 2*b* are arranged so that they contact the photosensitive drums 1*a* and 1*b* or are close to the photosensitive drums 1*a* and 1*b*. Electrodes are provided for both end portions of the charging rollers 2*a* and 2*b* in lengthwise directions of the metal cores and charging biases are applied from charging bias application power supplies (not shown) through the electrodes. As the charging biases, it is possible to use a bias in which an AC (alternating current) bias and a DC (direct current) bias are superimposed on each other. For instance, the AC bias has a frequency of 1400 Hz, has a peak-to-peak voltage of around 1200 to 2500 V, and is constant-current-controlled at around 1200 to 1700 μA. On the other hand, as the DC bias,. −400 to −800 V is applied. The charging rollers 2*a* and 2*b* uniformly charge surfaces of the photosensitive drums 1*a* and 1*b* to predetermined polarities and potentials through application of such charging biases to the metal cores. Note that the charging rollers 2*a* and 2*b* are respectively arranged in cleaning containers 21*a* and 21*b* to be described later.

As the exposing devices 3*a* and 3*b*, for instance, laser scanners are used. The exposing devices 3*a* and 3*b* form electrostatic latent images by removing electric charges in exposure portions (image regions) through exposure of the surfaces of the photosensitive drums 1*a* and 1*b* after the charging to laser light based on image information.

The developing devices 4*a* and 4*b* develop the electrostatic latent images formed on the photosensitive drums 1*a* and 1*b* with the toner. The developing devices 4*a* and 4*b* respectively include developing containers 11*a* and 11*b* containing two-component developers whose main ingredients are non-magnetic toner and magnetic carrier. For the developing containers 11*a* and 11*b*, opening portions 12*a* and 12*b* are formed in portions opposed to the photosensitive drums 1*a* and 1*b*. In the opening portions 12*a* and 12*b*, the developing sleeves (developer bearing members) 13*a* and 13*b* that are developing members are arranged. The developing sleeves 13*a* and 13*b* are each a cylindrical member that is made of a material such as aluminum or non-magnetic stainless steel, and has an outer peripheral surface including projections and depressions that are appropriate for bearing the developer. Inside the developing sleeves 13*a* and 13*b*, magnet rollers 14*a* and 14b having multiple magnetic poles are arranged fixedly (under a non-rotation state). The developing sleeves 13*a* and 13*b* are each rotationally driven by drive means (not shown) at a peripheral velocity Vb in an arrow direction. In the developing containers 11*a* and 11*b*, agitating screws 15*a* and 15*b* that agitate and feed the developers are arranged. The developers in the developing containers 11*a* and 11*b* are agitated and fed by the agitating screws 15*a* and 15*b* and are borne on surfaces of the developing sleeves 13*a* and 13*b* by means of magnetic force of the magnet rollers 14*a* and 14*b*. Through rotation of the developing sleeves 13*a* and 13*b*, the borne developers are regulated to an appropriate layer thickness by layer thickness regulating blades (not shown) and are fed to developing positions (developing regions) D opposed to the photosensitive drums 1*a* and 1*b*.

The developers fed to the developing positions D form magnetic brushes by means of the magnetic force of the magnetic poles (developing poles) opposed to the developing positions D and contact the photosensitive drums 1*a* and 1*b* that are rotated at the peripheral velocity Va in the arrow direction. Under this state, high-voltage developing biases are applied to the developing sleeves 13*a* and 13*b* from developing bias application power supplies (not shown). As a result, the toner in the developers on the developing sleeves 13*a* and 13*b* is transferred and adheres to exposure portions (image regions) of the electrostatic latent images and develops the electrostatic latent images as toner images (developer images).

The toner images formed on the photosensitive drums 1*a* and 1*b* in this manner are transferred by the transferring rollers 5*a* and 5*b* to the intermediate transferring belt 7 in succession. The transferring rollers 5*a* and 5*b* press the intermediate transferring belt 7 from its back side and abut the surface of the intermediate transferring belt 7 against the photosensitive drums 1*a* and 1*b*. As a result, transferring portions (primary transferring nip portions) Ta and Tb are formed between the photosensitive drums 1*a* and 1*b* and the intermediate transferring belt 7. Through application of transferring biases to the transferring rollers 5*a* and 5*b*, the toner images formed on the photosensitive drums 1*a* and 1*b* are primarily transferred onto the intermediate transferring belt 7 in succession in the transferring portions Ta and Tb and are superimposed on each other on the intermediate transferring belt 7.

The toner images primarily transferred onto the intermediate transferring belt 7 in this manner are secondarily transferred to the recording material P supplied from the sheet feeding and conveying device (not shown) in a secondary transferring portion (not shown) by one operation. Following this, the recording material P is conveyed to a fixing device (not shown) at which the toner images are fixed to a surface of the recording material P through heating and pressurizing.

On the other hand, toner (transfer residual toner) remaining on the surfaces of the photosensitive drums 1*a* and 1*b* after the primary transferring of the toner images is removed by the cleaning devices 6*a* and 6*b*. The cleaning devices 6*a* and 6*b* include cleaning containers 21*a* and 21*b*, support members 22*a* and 22*b* fixed inside the cleaning containers 21*a* and 21*b*, and cleaning members 23*a* and 23*b* supported by the support members 22*a* and 22*b*. In this embodiment, the cleaning members are each a cleaning blade. The support members 22*a* and 22*b* are composed of conductive members, such as metallic plates, formed in a rectangular shape which is long in the axial direction of the photosensitive drums 1*a* and 1*b*. Also, the support members 22*a* and 22*b* are grounded. One of the longitudinal ends (base-end side) of the support members 22*a* and 22*b* are fixed to the inside of the cleaning containers 21*a* and 21*b* and the other of longitudinal ends (tip-end side) thereof are free. To the free ends, the plate-shaped cleaning blades 23*a* and 23*b* made of a synthetic resin are fixed. One edge of the cleaning blades 23*a* and 23*b* are brought into pressure contact with the surface of the photosensitive drums 1*a* and 1*b* with a predetermined inroad amount and abutment pressure. With this construction, the cleaning devices 6*a* and 6*b* clean the surfaces of the photosensitive drums 1*a* and 1*b* by removing extraneous matters, such as transfer residual toner, which adhere onto the photosensitive drums 1*a* and 1*b*. The photosensitive drums 1*a* and 1*b* after the cleaning are applied to the next image formation.

Next, characteristic portions of this embodiment will be described in detail.

Figure 2:
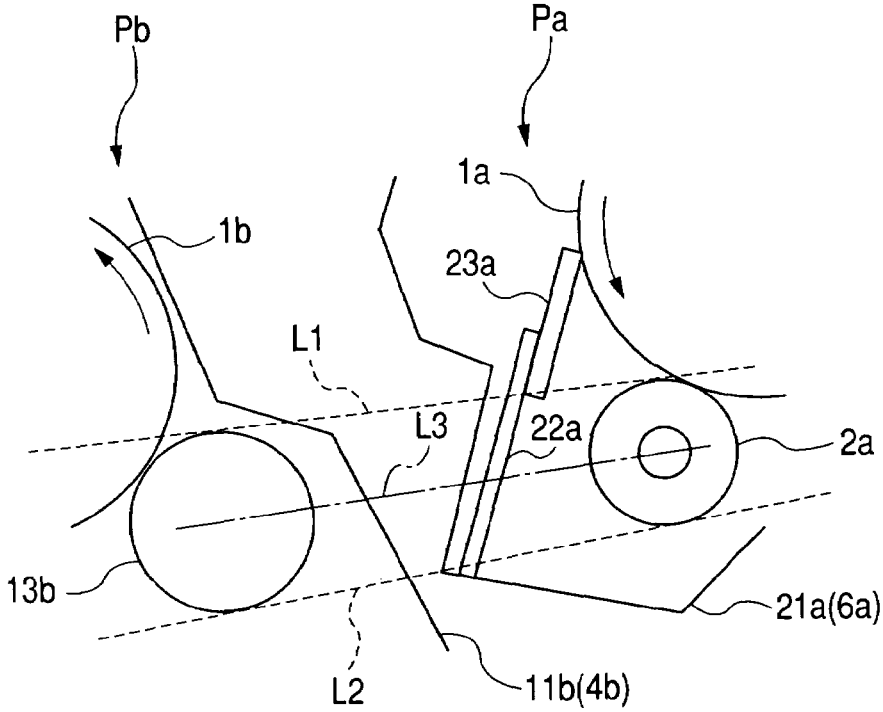
FIG. 2 is an enlarged cross-sectional view of a boundary between the image forming unit of the upstream side and the image forming unit of the downstream side and a vicinity of the boundary according to the first embodiment of the present invention.

FIG. 2 is an enlarged cross-sectional view of a boundary portion between the image forming units Pa and Pb and its vicinity. In this embodiment, the support member 22*a* described above that supports the cleaning blade 23*a* is arranged so that it shields a space between the charging roller 2*a* of the image forming unit Pa on the upstream side and the developing sleeve 13*b* of the image forming unit Pb on the downstream side. In addition, the support member 22*a* is grounded. In this embodiment, a straight line connecting the center of the charging roller 2*a* and the center of the developing sleeve 13*b* is set as a centerline L3, as shown in FIG. 2. Also, out of four common tangents that can be drawn between the charging roller 2*a* and the developing sleeve 13*b*, a common tangent entirely positioned on an upper side of the centerline L3 is a tangent L1 and a common tangent entirely positioned on a lower side is a tangent L2. In this embodiment, the plate-shaped support member 22*a* is arranged so that it intersects the centerline L3 and also intersects the tangents L1 and L2. That is, as shown in FIG. 2, when a space between the charging roller 2*a* and the developing sleeve 13*b* is determined as a space between the tangent L1 and the tangent L2, the support member 22*a* completely goes across the space. In other words, a construction is obtained in which the support member 22*a* completely shields the space. Still in other words, a construction is obtained in which the support member 22*a* is provided in an estimated angle of the developing sleeve 13*b* with respect to the charging roller 2*a*. The estimated angle of a developing member with respect to a charging member is defined by two common tangents on the outer circumference of the developing member and the outer circumference of the charging member. Note that the support member 22*a* is constructed so that a contact point is indirectly formed using a conductive screw (not shown) or the like outside the image forming unit Pa and when the image forming unit Pa is attached to the image forming apparatus main body, a ground can be established. Also, the lengths in lengthwise directions of the sheet metal portion of the cleaning blade 23*a*, the developing sleeve 13*b*, and the charging roller 2*a* are respectively 330 mm, 350 mm, and 350 mm. It is preferable that the length in the lengthwise direction of the developing sleeve 13*b* and the length in the lengthwise direction of the sheet metal portion of the cleaning blade 23*a* be close to each other as much as possible like in this embodiment.

With the construction described above, the charging roller 2*a* is set so that it will be hardly influenced by the alternating current bias among the developing bias applied to the developing sleeve 13*b*.

Figure 3:
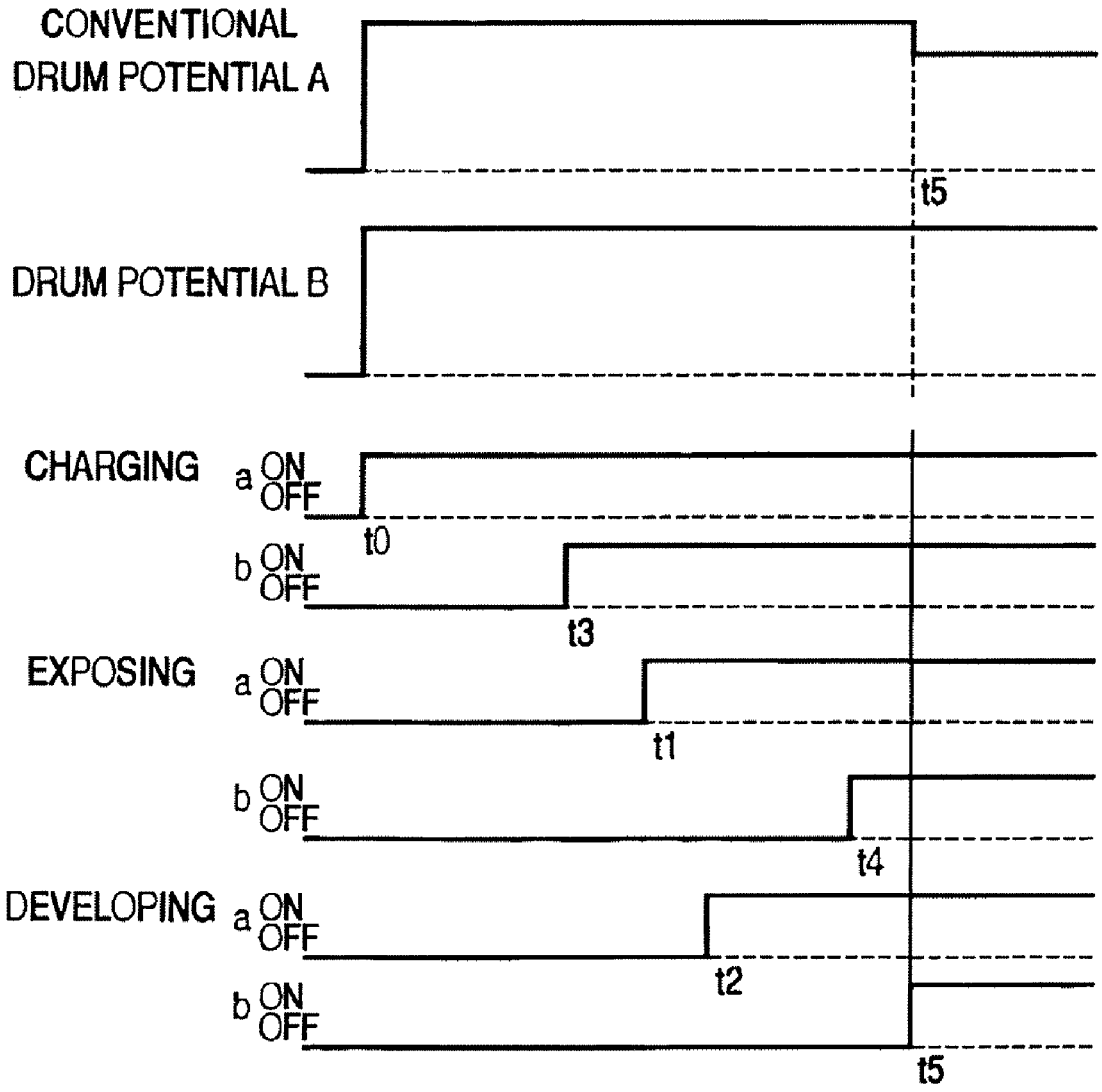
FIG. 3 is a time chart for explaining the timings of ON/OFF of charging, exposing, and developing as well as a photosensitive drum potential according to the conventional type and a photosensitive drum potential according to the present invention.

FIG. 3 shows image forming sequences of the image forming units Pa and Pb and a result of monitoring a drum potential (drum surface potential) of the photosensitive drum 1*a* in the image forming unit Pa after passing through the charging portion.

Here, a drum potential A in the figure indicates a potential in a conventional example that is a system in which the space between the charging roller and the developing sleeve is not shielded. In contrast to this, a drum potential B indicates a potential in the case where the support member 22*a* is arranged in the manner described above and is grounded.

Charging, exposing, and a developing AC (developing bias AC component) in the image forming unit Pa and charging, exposing, and a developing AC in the image forming unit Pb are distinguished from each other using reference symbols "a" and "b".

A bias is supplied to the charging a (charging roller 2*a*) at a time t0, a bias is supplied to the charging b (charging roller 2*b*) at a time t3, and drum surface potentials rise. A lag between the times t0 and t3 depends on the distance between the image forming units Pa and Pb. When the drums have made one rotation after start of the charging, the exposing a and b by the exposing devices 3*a* and 3*b* is started at times t1 and t4. In synchronization with a situation in which exposing start points have reached the developing positions D (see FIG. 1), the developing ACs to the developing sleeves 13*a* and 13*b* are raised at times t2 and t5 and developing is started.

When no shielding member is provided between the charging roller 2*a* of the image forming unit Pa on the upstream side and the developing sleeve 13*b* of the image forming unit Pb on the downstream side like in the conventional case, the following problem occurs. When the developing AC to the image forming unit Pb on the downstream side is raised at the time t5, noise exerts an influence at the time of rising of the charging bias to the charging roller 2*a* of the image forming unit Pa on the upstream side and a surface potential step observed in the case of the drum potential A is generated.

On the other hand, when the space between the charging roller 2*a* of the image forming unit Pa on the upstream side and the developing sleeve 13*b* of the image forming unit Pb on the downstream side is completely shielded with the support member 22*a* like in this embodiment, the following situation results. As indicated by the drum potential B, no variation in potential ascribable to the rising of the developing AC to the image forming unit Pb on the downstream side is observed at the time t5.

As described above, the support member 22*a* functions as a shielding member. Therefore, it becomes possible to arrange the charging roller 2*a* on the upstream side and the developing sleeve 13*b* on the downstream side in proximity to each other, which makes it possible to arrange the image forming unit Pa on the upstream side and the image forming unit Pb on the downstream side in proximity to each other. As a result, it becomes possible to reduce a distance between the image forming unit Pa on the upstream side and the image forming unit Pb on the downstream side, which makes it possible to reduce the overall size of the image forming apparatus.

In addition, in this embodiment, no shielding member is newly provided and the support member that supports the cleaning blade is set to double as the shielding member. Therefore, it becomes possible to prevent an increase of the number of components and reduce the apparatus size as compared with a case where the shielding member is newly provided.

Second Embodiment

Figure 4:
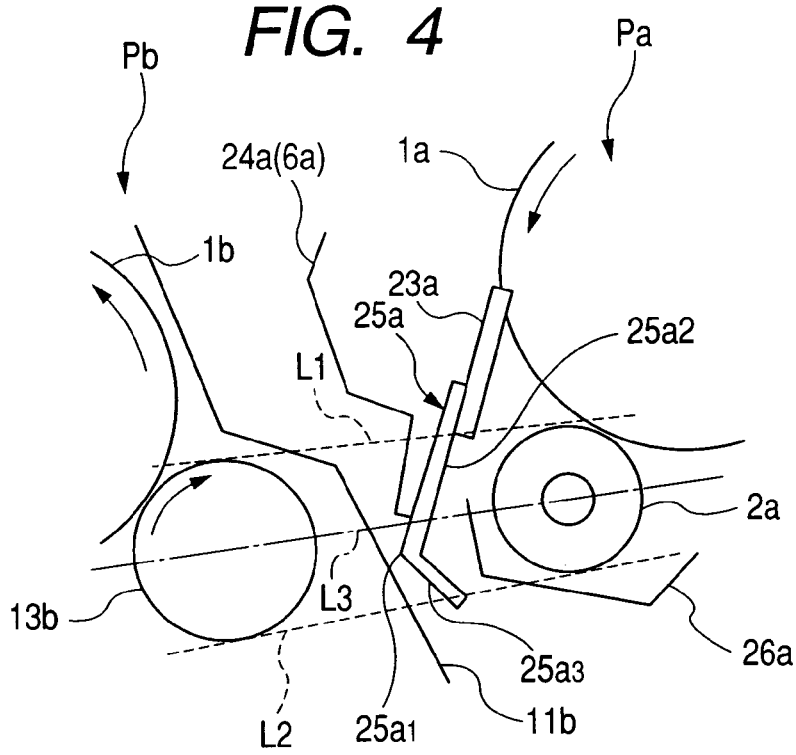
FIG. 4 is an enlarged cross-sectional view of a boundary between an image forming unit of an upstream side and an image forming unit of a downstream side and a vicinity of the boundary according to a second embodiment of the present invention.

FIG. 4 shows a second embodiment of the present invention. In this embodiment, a base-end-side portion 25*a*3 of a support member 25*a* that supports a cleaning blade 23*a* is folded to cover a charging roller 2*a*.

In order to obtain a sufficient shielding effect with the support member 25*a*, it is required that the support member 25*a* completely shield tangents L1 and L2 between the charging roller 2*a* and a developing sleeve 13*b* as described above.

When the base-end portion 25*a*3 of the support member 25*a* that supports the cleaning blade 23*a* is extended in a straight line manner in accordance with a tip-end portion 25*a*2 as shown in FIG. 4, however, there is a fear that interference with the developing container 11*b* of the image forming unit Pb on the downstream side will occur. Also, when the distance between the image forming units Pa and Pb is increased in order to prevent the interference, the overall size of the image forming apparatus increases.

Therefore, in this embodiment, in order to prevent the interference of the base-end-side portion 25*a*3 of the support member 25*a*, the base-end-side portion 25*a*3 is folded in a folding portion 25*a*1 toward a charging roller side.

With this construction, it becomes possible to achieve a reduction of the overall size of the image forming apparatus while maintaining the effect of shielding the charging roller 2*a*. In addition, through the folding, it also becomes possible to increase the strength of the support member 25*a*.

It should be noted here that in the figure, reference symbol 24*a* denotes a cleaning container and reference symbol 26*a* indicates a charging roller cover.

Also, in this embodiment, like in the first embodiment, a construction is obtained in which the support member 25*a* completely goes across the tangents L1 and L2 as shown in FIG. 4, although the present invention is not limited to this. For instance, it is sufficient that the support member 25*a* goes across at least the tangent L1 on an upper side and the centerline L3. Even in this case, it is possible to provide an adequate effect.

Further, in the above description, a case where the support member 25*a* is folded in the folding portion 25*a*1 has been explained as an example, although it is of course possible to use a construction in which the base-end-side portion 25*a*3 is curved, instead.

Third Embodiment

Figure 5:
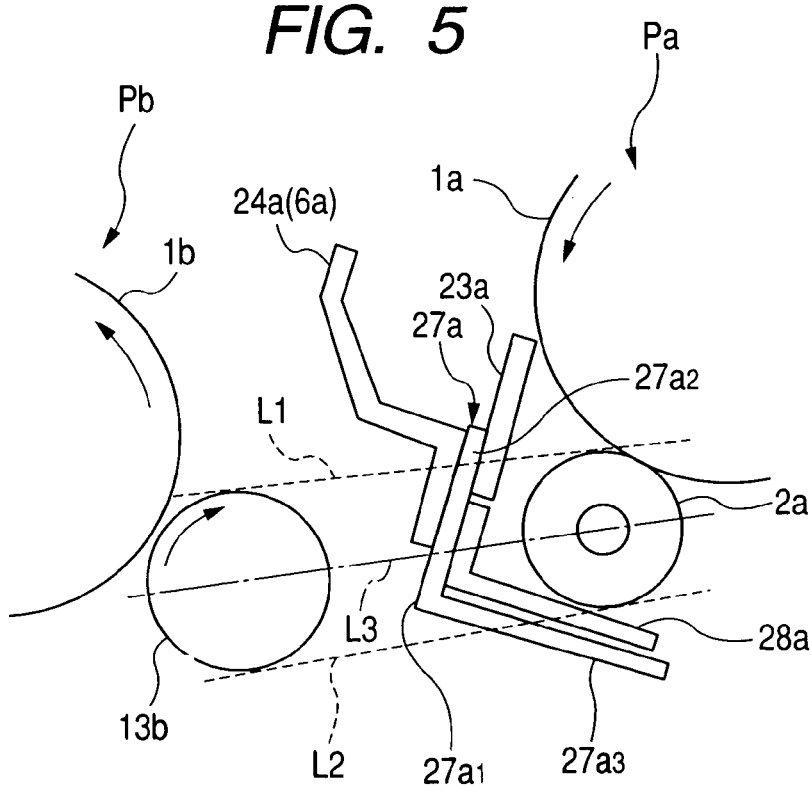
FIG. 5 is an enlarged cross-sectional view of a boundary between an image forming unit of an upstream side and an image forming unit of a downstream side and a vicinity of the boundary according to a third embodiment of the present invention.
Figure 6:
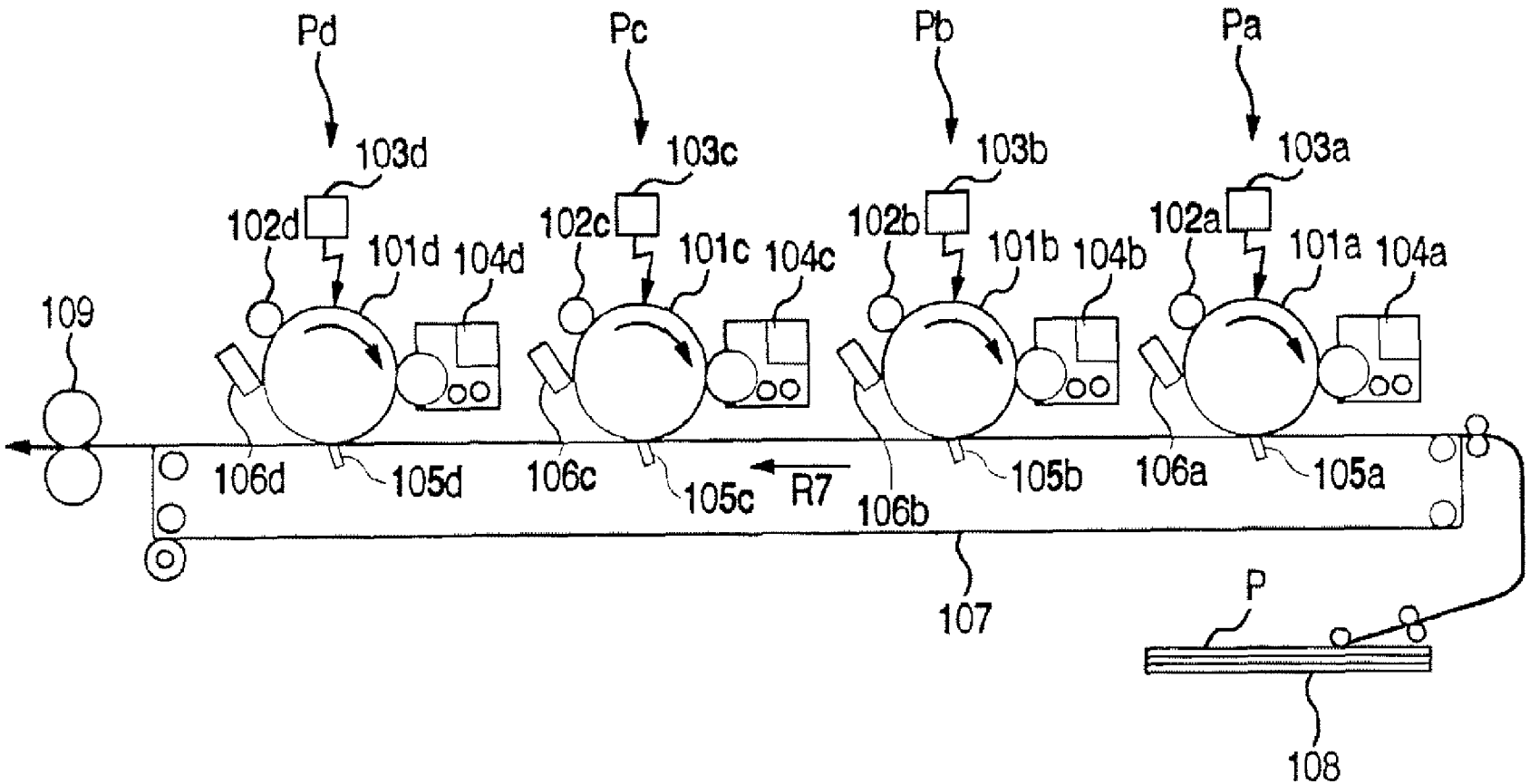
FIG. 6 PRIOR ART
FIG. 6 schematically shows a general construction of a conventional image forming apparatus adopting a tandem system.

FIG. 5 shows a third embodiment of the present invention. A support member 27*a* in this embodiment is constructed so that a base-end portion 27*a*3 is folded in a folding portion 27*a*1 with respect to a tip-end portion 27*a*2 and is extended to go under the charging roller 2*a* and a container 28*a* positioned in an outer peripheral portion of the charging roller 2*a* is covered with the support member 27*a*. Note that the container 28*a* is a part of a cleaning container 24*a*.

The charging roller 2*a* is pressurized and abutted against the surface of the photosensitive drum 1*a* through energization of metal core portions (not shown) in both end portions in a lengthwise direction toward the photosensitive drum 1*a* by a pressurizing member (not shown) such as a spring.

Here, when it is desired to further reduce the size of the image forming apparatus, it is effective to reduce the distance between the charging roller 2*a* and the container 28*a*. Under such a positional relation, there is a case where when a user has detached the image forming unit from the image forming apparatus main body and grasps the container 28*a* positioned below the charging roller 2*a*, the lower portion of the container 28*a* and the charging roller 2*a* may rub against each other. When the surface of the charging roller 2*a* is rubbed, scratches are made in the surface, which leads to image defects. Also, even when image degradation does not occur immediately afterward, when surface smoothness decreases, the surface tends to be soiled, which shortens the life span of the charging roller 2*a*.

In contrast to this, when the support member 27*a* is folded in this embodiment in which the support member 27 covers the container 28*a* positioned below the charging roller 2*a* the base-end portion 27*a*3 of the support member 27*a* functions as a protective member. With this construction, even when the user has made an operation error, it becomes possible to prevent the charging roller 2*a* from being damaged.

In this embodiment, an example has been described in which another abutment member is not provided for the charging roller 2*a*, although the present invention is not limited to this. For instance, even when plate-shaped pad means or sheet means for cleaning or rotatably arranged roller means or brush means is arranged, the bent support member 27*a* described above makes it possible to prevent the abutment member from directly contacting the container 28*a*. In addition, it becomes possible to prevent a harmful effect of a situation in which the abutment member is abnormally pressurized through the container 28*a*.

A cartridge that is detachably attachable to the image forming apparatus main body may be constructed by integrating the photosensitive drum, the charging roller, and the cleaning device with each other in each of the image forming units Pa and Pb described above. Even in this case, when the cartridge is attached to the image forming apparatus main body, the support member integrated into the cartridge effectively functions as the shielding member between the charging roller in the cartridge and the developing sleeve on the downstream side.

In the embodiments described above, a case where the charging members are the charging rollers has been described as an example, although the present invention is not limited to this. For instance, the charging members may be corona chargers or magnetic brush chargers. Also in this case, in principle, it is possible to provide the same effect.

Also, in the above description, a construction in which the toner images formed on the photosensitive drums are primarily transferred to the intermediate transferring belt that is an intermediate transferring member, has been explained as an example, although the present invention is also applicable to an image forming apparatus adopting a system in which toner images formed on photosensitive drums are directly transferred to a recording material P borne by a recording material bearing member (recording material bearing belt). Note that in this case, the recording material P that is a transferring destination of the toner images on the photosensitive drums corresponds to the other member.

Further, in the above description, the most simplified example has been explained in which two image forming units are provided, although the present invention is applicable to every image forming apparatus adopting a so-called tandem system in which multiple (two or more) image forming units are arranged side by side. For instance, a four-color full-color image forming apparatus generally includes four image forming units. In this case, the present invention is applied to each space between an image forming unit on an upstream side and an image forming unit on a downstream side that are adjacent to each other.

The present invention has been described above based on preferred embodiments, although the present invention is not limited to the embodiments and various modifications can be made within the scope of the technical idea of the present invention.

This application claims priority from Japanese Patent Application No. 2004-329876 filed on Nov. 12, 2004, which is hereby incorporated by reference herein.

What is claimed is:

1. An image forming apparatus comprising a plurality of image forming units having at least first and second image forming units that are adjacently provided, wherein each of said at least first and second image forming units includes:

an image bearing member rotatable about a rotation axis;

a charging member that charges a surface of the image bearing member;

a developing device including a developing member that develops an electrostatic latent image formed by exposing said image bearing member; and a cleaning device including a cleaning member and a conductive support member that supports the cleaning member, for cleaning the surface of the image bearing member after developer image transfer, wherein the conductive support member of the first image forming unit is provided from one end portion side to another end portion side in a longitudinal direction of the first image forming unit so as to intersect the conductive support member of the first image forming unit with each of a first boundary line and a second boundary line, the first boundary line being defined as a line connecting a center of a cross section of the charging member of the first image forming unit and a center of a cross section of the developing device of the second image forming unit on a plane perpendicular to a direction of the rotation axis of the image bearing member, the second boundary line being defined as one of two common external tangent lines of a cross section of the charging member of the first image forming unit and a cross section of the developing device of the second image forming unit on a plane perpendicular to a direction of the rotation axis of said image bearing member, wherein a position of a contact point on the one of the two common external tangent lines with the charging member of the first image forming unit is closer to the cleaning device of the first image forming unit than a position of a contact point on another one of the two common external tangent lines with the charging member of the first image forming unit, wherein the conductive support member of the first image forming unit is grounded.

2. An image forming apparatus according to claim 1, wherein the conductive support member of the first image forming unit is provided so as to intersect with each of the two common external tangent lines.

3. An image forming apparatus according to claim 1, wherein the conductive support member of the first image forming unit has a curved or bent portion in which the conductive support member is curved or bent toward said charging member of the first image forming unit from an end of the conductive support member which supports the cleaning member to an end opposite to the end of the conductive support member.

4. An image forming apparatus according to claim 3, wherein the curved or bent portion functions as a protective member of said charging member.

5. An image forming apparatus according to claim 1, wherein a cartridge detachably attachable to an image forming apparatus main body is constructed by integrating the image bearing member, the charging member, and the cleaning device with one another.

6. An image forming apparatus according to claim 1, comprising a rotation member provided opposite to the first and second image forming units, wherein the first image forming unit is provided on an upstream side of the second image forming unit in a rotation direction of the rotation member.

7. An image forming apparatus to claim 6, wherein said rotation member is an intermediate transfer member to which an image is transferred from the first and the second image forming units, or a recording material bearing member which bears recording material to which an image is transferred from the first and the second image forming units.

* * * * *